US008989411B2

(12) United States Patent
Hall et al.

(10) Patent No.: US 8,989,411 B2
(45) Date of Patent: Mar. 24, 2015

(54) DIFFERENTIAL MICROPHONE WITH SEALED BACKSIDE CAVITIES AND DIAPHRAGMS COUPLED TO A ROCKING STRUCTURE THEREBY PROVIDING RESISTANCE TO DEFLECTION UNDER ATMOSPHERIC PRESSURE AND PROVIDING A DIRECTIONAL RESPONSE TO SOUND PRESSURE

(75) Inventors: Neal A. Hall, Austin, TX (US); Michael Louis Kuntzman, Austin, TX (US); Karen Denise Kirk, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 218 days.

(21) Appl. No.: 13/441,079

(22) Filed: Apr. 6, 2012

(65) Prior Publication Data

US 2012/0257778 A1 Oct. 11, 2012

Related U.S. Application Data

(60) Provisional application No. 61/473,217, filed on Apr. 8, 2011.

(51) Int. Cl.
*H04R 25/00* (2006.01)
*H04R 23/00* (2006.01)

(52) U.S. Cl.
CPC ..... *H04R 23/00* (2013.01)
USPC ..... 381/175; 381/174; 381/178; 381/355; 381/356; 381/361; 381/369; 438/53; 257/678; 257/723; 73/504.01

(58) Field of Classification Search
None
See application file for complete search history.

(56) References Cited

U.S. PATENT DOCUMENTS

| | | | | |
|---|---|---|---|---|
| 5,259,247 | A * | 11/1993 | Bantien | 73/718 |
| 5,706,565 | A * | 1/1998 | Sparks et al. | 29/25.42 |
| 6,788,796 | B1 | 9/2004 | Miles et al. | |
| 6,958,255 | B2 * | 10/2005 | Khuri-Yakub et al. | 438/48 |
| 6,963,653 | B1 * | 11/2005 | Miles | 381/424 |
| 2006/0272413 | A1 * | 12/2006 | Vaganov et al. | 73/514.01 |
| 2006/0284516 | A1 * | 12/2006 | Shimaoka et al. | 310/322 |
| 2007/0003082 | A1 * | 1/2007 | Pedersen | 381/191 |
| 2009/0046883 | A1 * | 2/2009 | Ronald | 381/369 |
| 2009/0147968 | A1 * | 6/2009 | Inoda et al. | 381/94.1 |
| 2010/0054494 | A1 | 3/2010 | Chen | |
| 2011/0222708 | A1 * | 9/2011 | Yu et al. | 381/92 |

OTHER PUBLICATIONS

Miles, et al., "A Low-Noise Differential Microphone Inspired by the Ears of the Parasitoid Fly *Ormia ochracea*," J. Acoust. Soc. Am. 125 (4), Apr. 2009.

* cited by examiner

*Primary Examiner* — Duc Nguyen
*Assistant Examiner* — Taunya McCarty
(74) *Attorney, Agent, or Firm* — Robert A. Voigt, Jr.; Winstead, P.C.

(57) ABSTRACT

A vacuum sealed directional microphone and methods for fabricating said vacuum sealed directional microphone. A vacuum sealed directional microphone includes a rocking structure coupled to two vacuum sealed diaphragms which are responsible for collecting incoming sound and deforming under sound pressure. The rocking structure's resistance to bending aids in reducing the deflection of each diaphragm under large atmospheric pressure. Furthermore, the rocking structure exhibits little resistance about its pivot thereby enabling it to freely rotate in response to small pressure gradients characteristic of sound. The backside cavities of such a device can be fabricated without the use of the deep reactive ion etch step thereby allowing such a microphone to be fabricated with a CMOS compatible process.

21 Claims, 13 Drawing Sheets

DIFFERENTIAL MICROPHONE WITH SEALED BACKSIDE CAVITIES AND DIAPHRAGMS COUPLED TO A ROCKING STRUCTURE THEREBY PROVIDING RESISTANCE TO DEFLECTION UNDER ATMOSPHERIC PRESSURE AND PROVIDING A DIRECTIONAL RESPONSE TO SOUND PRESSURE

CROSS-REFERENCE TO RELATED APPLICATIONS

This application is related to the following commonly owned U.S. patent application:

Provisional Application Ser. No. 61/473,217, "Differential Microphone with Sealed Backside Cavities and Diaphragms Coupled to a Rocking Structure Thereby Providing Resistance to Deflection Under Atmospheric Pressure and Providing a Directional Response to Sound Pressure," filed Apr. 8, 2011, and claims the benefit of its earlier filing date under 35 U.S.C. §119(e).

GOVERNMENT INTERESTS

This invention was made with government support under DC009721 awarded by the National Institutes of Health. The U.S. Government has certain rights in the invention.

TECHNICAL FIELD

The present invention relates generally to miniature microphones, and more particularly to a micromachined differential microphone with sealed backside cavities where the diaphragms are coupled to a rocking structure thereby providing resistance to deflection under external atmospheric pressure and providing a directional response to small dynamic sound pressure.

BACKGROUND

Miniature microphones, which may be used in various applications (e.g., cellular phones, laptop computers, portable consumer electronics, hearing aids), typically include a membrane and a rigid back electrode in close proximity to form a capacitor with a gap. Incoming sound induces vibrations in the compliant membrane and these vibrations change the capacitance of the structure which can be sensed with electronics. Typically, the structure of the microphone contains a large backside cavity and a small pressure release hole. The pressure release hole allows the large atmospheric pressure to reach the backside of the membrane. While the membrane compliance is designed to resolve dynamic pressure vibrations with magnitudes of 1 μPa to 1 Pa, atmospheric pressure is approximately 100 kPa (about a factor of $10^5$ times larger). Without a pressure release, it is challenging to design compliant membranes that do not collapse under atmospheric pressure.

Recently, microelectromechanical systems (MEMS) processing has been utilized to fabricate miniature microphones. However, most miniature microphones using MEMS processing use a deep reactive ion etch step through the entire silicon substrate, thereby preventing CMOS compatibility. If, however, miniature microphones could use MEMS processing without the use of the deep reactive ion etch step, then miniature microphones could be manufactured with CMOS compatible processes which have a significant cost advantage over other processes.

Furthermore, there is a desire to create a vacuum sealed microphone. By removing air from the gap, a microphone with much lower self-noise (which results in higher fidelity) can be fabricated with a potentially better frequency response. However, a very stiff diaphragm would be required to prevent the structure from collapsing under external atmospheric pressure, and such a structure would have poor sensitivity to small sound pressure due to its stiffness. Such structures have been manufactured using MEMS processing to realize ultrasound sensors but not functional microphones.

BRIEF SUMMARY

In one embodiment of the present invention, a microphone comprises a first and a second diaphragm, where the first and second diaphragms form a top layer of a first and a second backside sealed cavity. The microphone further comprises a rocking structure coupled to the first and second diaphragms, where the rocking structure rotates on a pivot and where the rocking structure is placed external to the first and second backside sealed cavities.

In another embodiment of the present invention, a microphone comprises a diaphragm, where the diaphragm forms a top layer of a backside sealed cavity. The microphone further comprises a rocking structure coupled to the diaphragm, where the rocking structure rotates on a pivot and where the rocking structure is placed internal in the backside sealed cavity.

In another embodiment of the present invention, a method for fabricating a microphone comprises depositing and patterning a first structural layer to form a first and a second electrode on a substrate. The method further comprises depositing and patterning a first sacrificial layer onto the patterned first structural layer. Additionally, the method comprises performing a dimpled cut in the first sacrificial layer used to create a pivot, where the dimpled cut etches the first sacrificial layer in a manner that leaves a portion of the first sacrificial layer on the substrate. The method further comprises depositing and patterning a second structural layer on the patterned first sacrificial layer to form a first and a second diaphragm, the pivot and a bottom layer of a rocking structure. In addition, the method comprises depositing and patterning additional structural layers to form other layers of the rocking structure.

In another embodiment of the present invention, a method for fabricating a microphone comprises depositing and patterning a first structural layer to form a first and a second electrode on a substrate and a bottom layer of post structures. The method further comprises depositing and patterning a first sacrificial layer onto the patterned first structural layer. Additionally, the method comprises performing a dimpled cut in the first sacrificial layer used to create a pivot, where the dimpled cut etches the first sacrificial layer in a manner that leaves a portion of the first sacrificial layer on the substrate. Furthermore, the method comprises depositing and patterning a second structural layer on the patterned first sacrificial layer to form the pivot and a bottom layer of a rocking structure. In addition, the method comprises depositing and patterning additional structural layers to form other layers of the rocking structure.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWINGS

A better understanding of the present invention can be obtained when the following detailed description is considered in conjunction with the following drawings, in which.

DETAILED DESCRIPTION

In the following description, numerous specific details are set forth to provide a thorough understanding of the present invention. However, it will be apparent to those skilled in the art that the present invention may be practiced without such specific details.

As stated in the Background section, recently, microelectromechanical systems (MEMS) processing has been used to fabricate miniature microphones. However, most miniature microphones using MEMS processing use the deep reactive ion through-wafer etch step thereby preventing CMOS compatibility. If, however, miniature microphones could use MEMS processing without the use of the through-wafer deep reactive ion etch step, then miniature microphones could be manufactured with CMOS compatible processes which have a significant cost advantage over other processes. Furthermore, there is a desire to create a vacuum sealed microphone. By removing air from the gap, a microphone with much lower self-noise (which results in higher fidelity) can be fabricated with a potentially better frequency response. However, a very stiff diaphragm would be required to prevent the structure from collapsing under external atmospheric pressure, and such a structure would have poor sensitivity to small sound pressure due to its stiffness.

Figure 1:
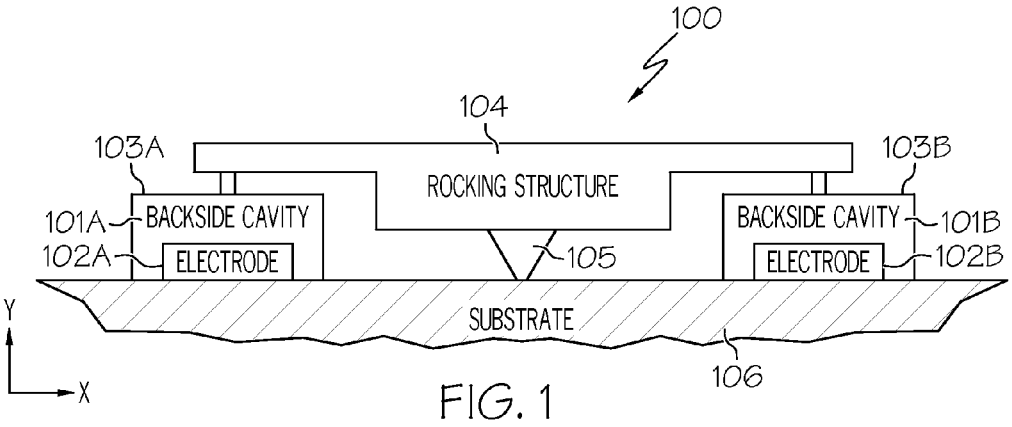
FIG. 1 illustrates a directional microphone configured in accordance with an embodiment of the present invention.
Figure 2:
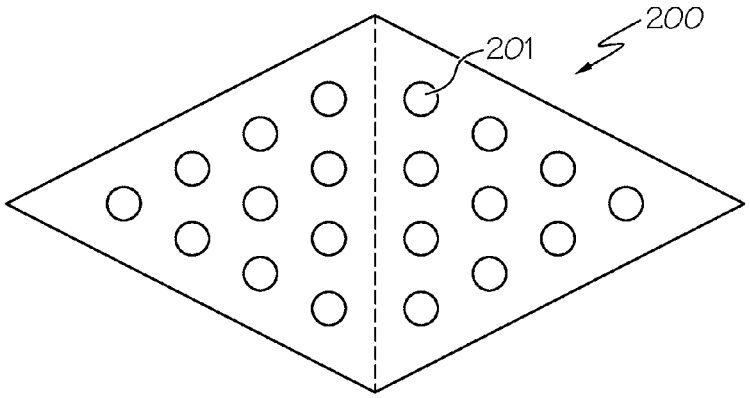
FIG. 2 illustrates an embodiment of the present invention of a top view of the rocking structure of the directional microphone of FIG. 1.
Figure 3:
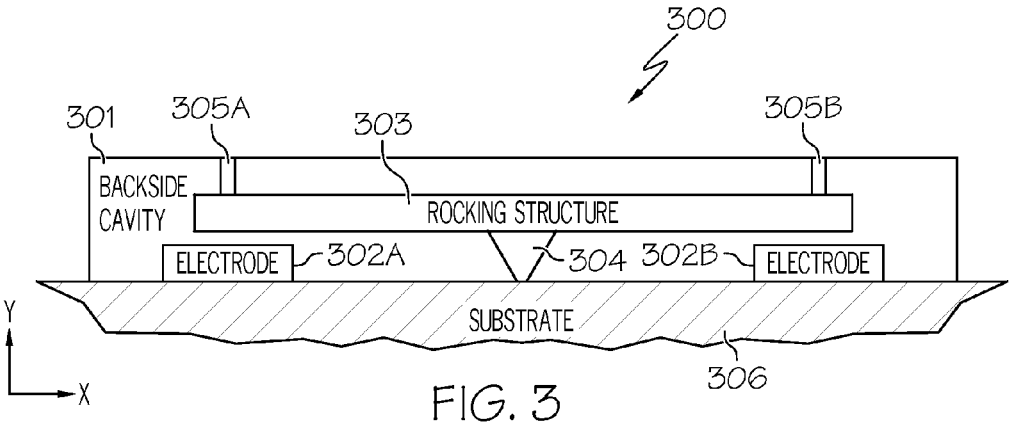
FIG. 3 illustrates an alternative embodiment of the present invention of a directional microphone.
Figure 4A:
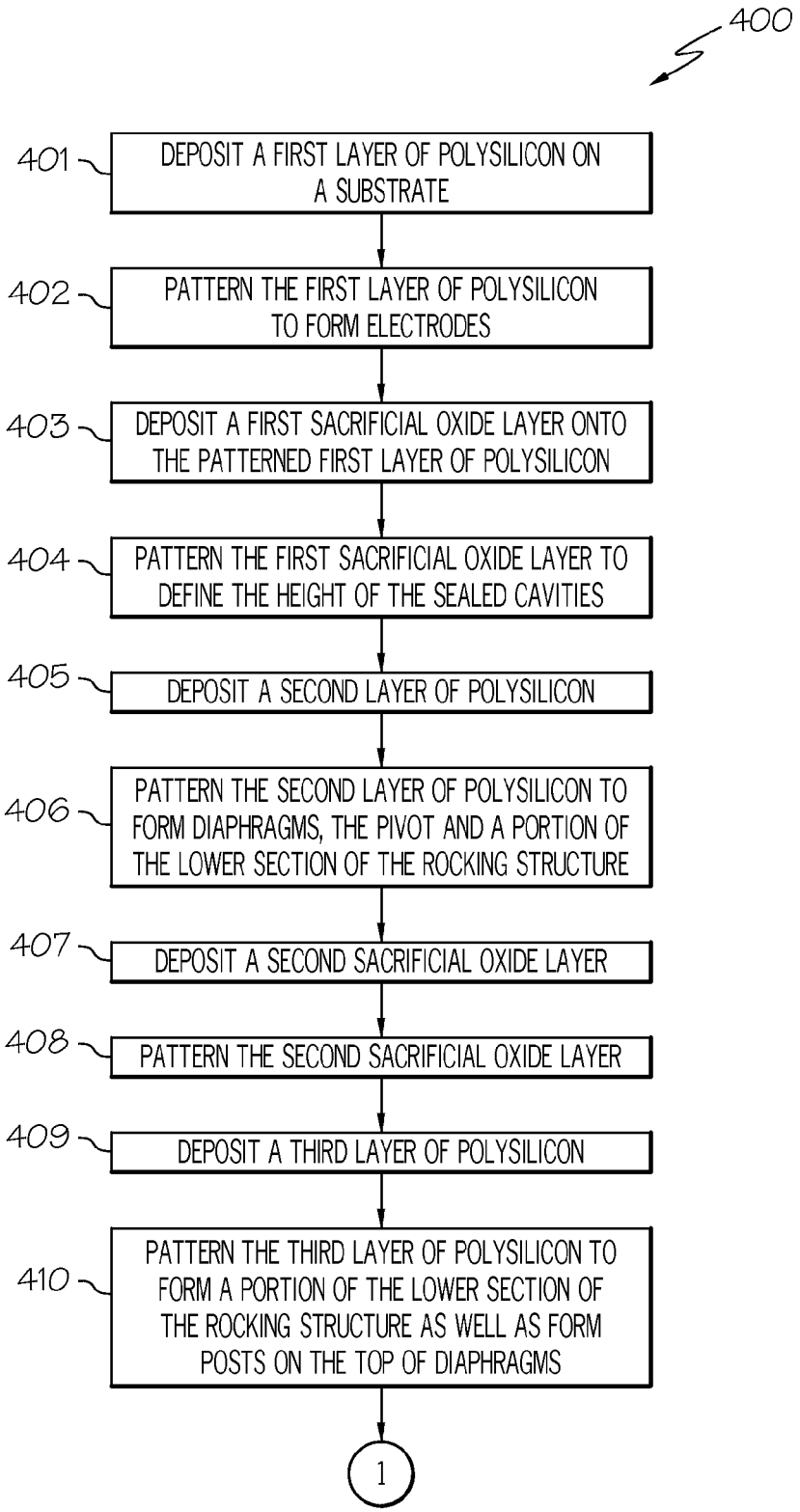
FIGS. 4A-4B are a flowchart of a method for fabricating the directional microphone of FIG. 1 in accordance with an embodiment of the present invention.
Figure 4B:
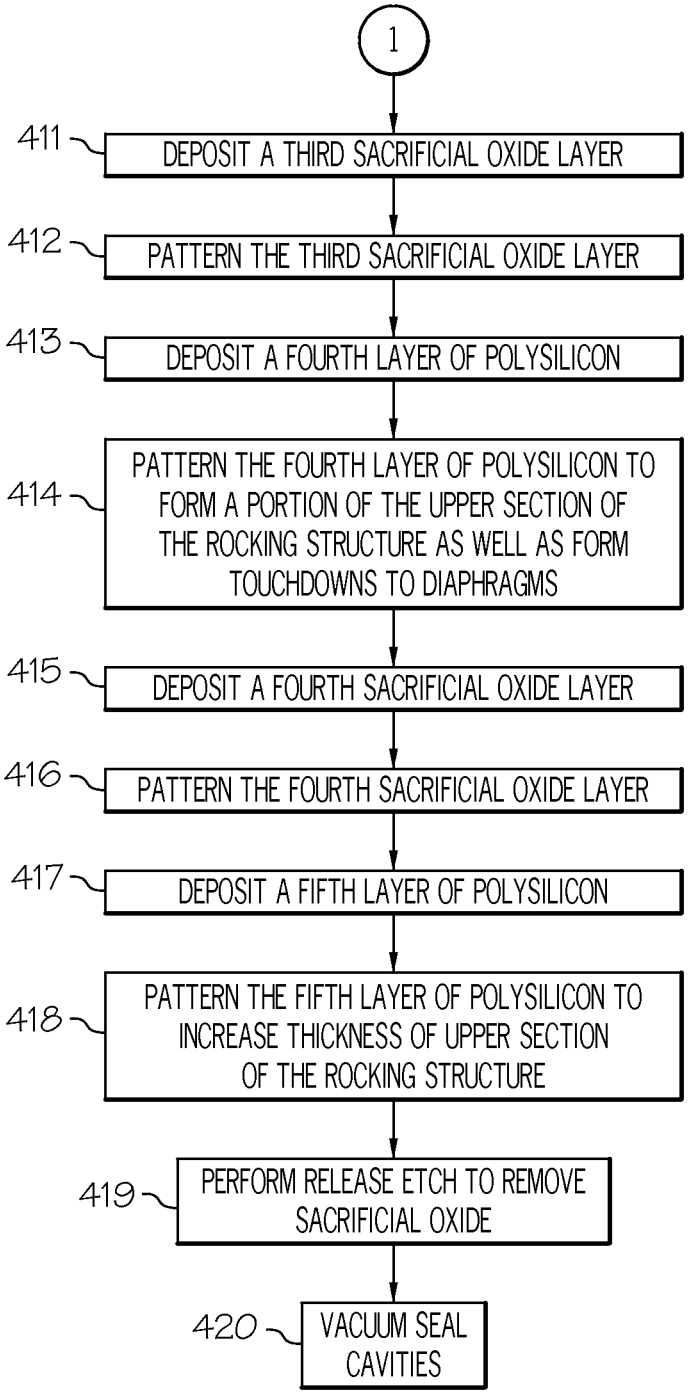
Figure 8:
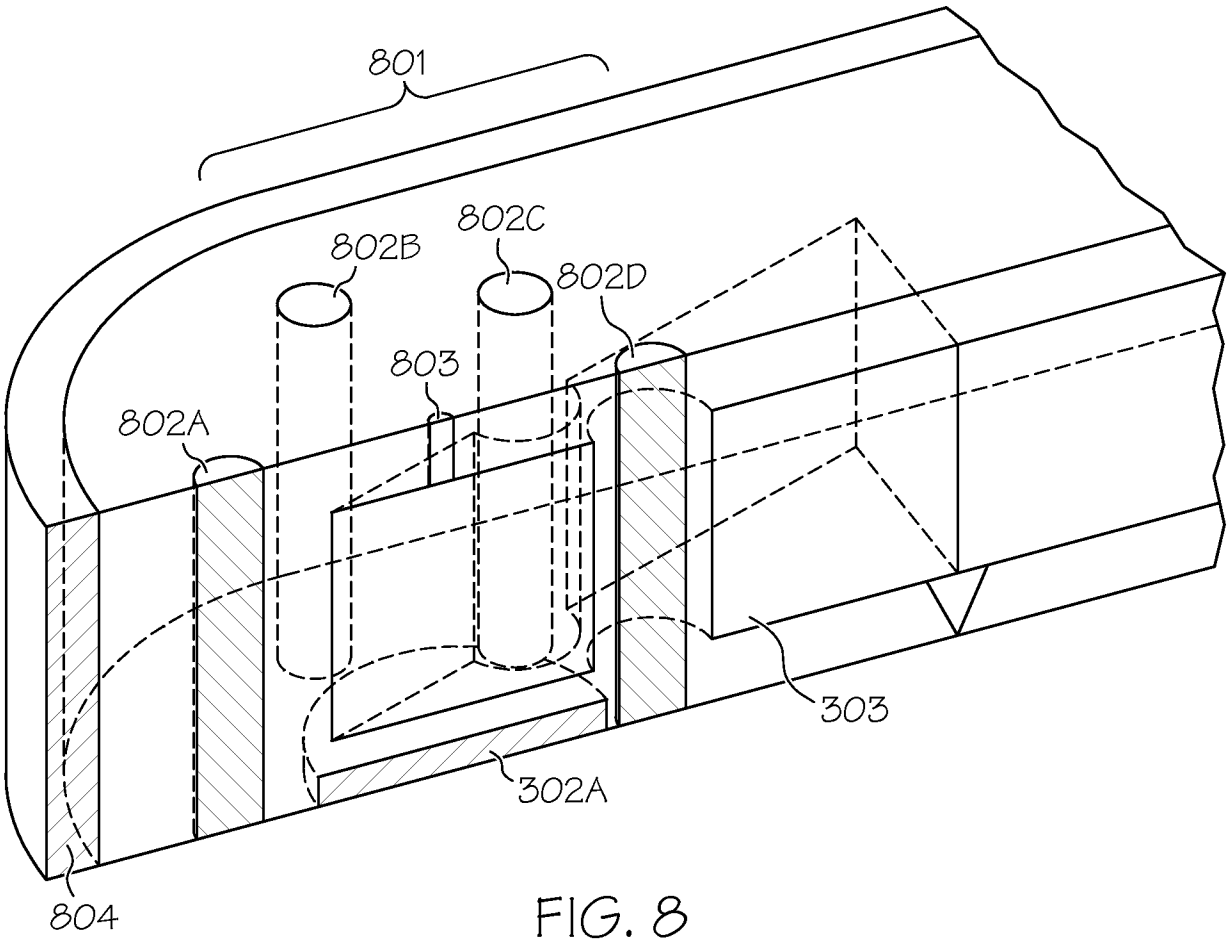
FIG. 8 illustrates post arranged in a circular manner to support a diaphragm region of the directional microphone of FIG. 3 in accordance with an embodiment of the present invention.
Figure 9A:
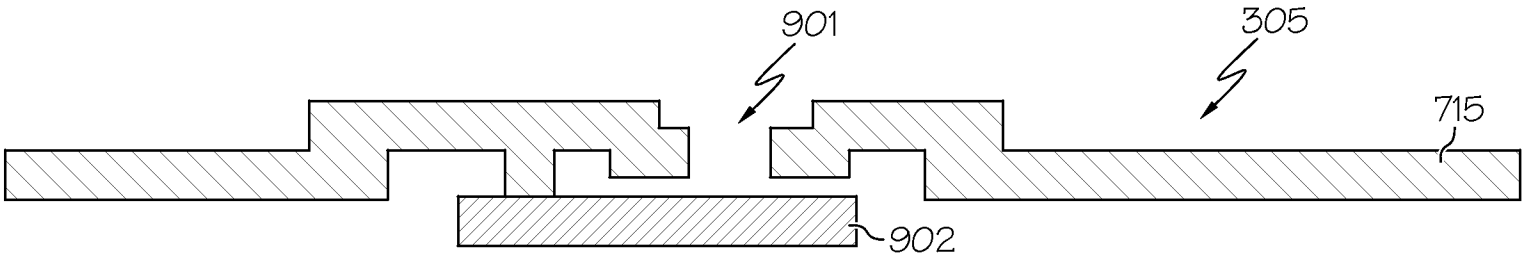
FIGS. 9A-9B illustrate the process of vacuum sealing the microphone of FIG. 3 in accordance with an embodiment of the present invention.
Figure 9B:
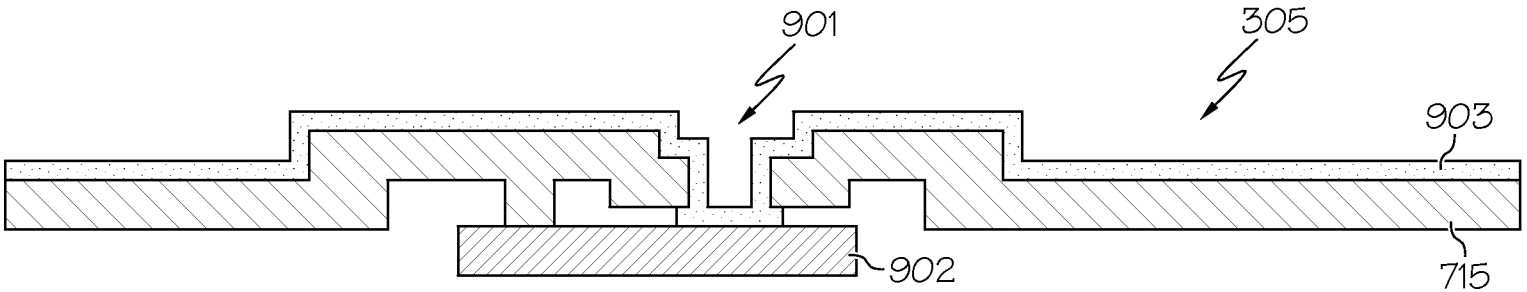

The principles of the present invention provide embodiments of a differential microphone (also referred to as a pressure gradient microphone) with sealed backside cavities that can be made with MEMS surface micromachining processes without the use of a through-wafer deep reactive ion etch as discussed further below in connection with FIGS. 1-3, 4A-4B, 5A-5J, 6A-6B, 7A-7J, 8 and 9A-9B. FIG. 1 illustrates one embodiment of a directional microphone with two sealed backside cavities where the motion of two vacuum sealed diaphragms are coupled to an external freely rotating rocking structure. FIG. 2 illustrates a top view of the rocking structure of the directional microphone of FIG. 1. FIG. 3 illustrates an alternative embodiment of a directional microphone where the rocking structure is contained within a single large vacuum sealed cavity and coupled to two compliant diaphragms along the top of the cavity. FIGS. 4A-4B are a flowchart of a method for fabricating the directional microphone of FIG. 1. FIGS. 5A-5J depict cross-sectional views of the directional microphone of FIG. 1 during the fabrication steps described in FIGS. 4A-4B. FIGS. 6A-6B are a flowchart of a method for fabricating the directional microphone of FIG. 3. FIGS. 7A-7J depict cross-sectional views of the directional microphone of FIG. 3 during the fabrication steps described in FIGS. 6A-6B. FIG. 8 illustrates posts arranged in a circular manner to support a diaphragm region of the directional microphone of FIG. 3; and FIGS. 9A-9B illustrate the process of vacuum sealing the microphone of FIG. 3.

Referring now to the Figures in detail, FIG. 1 illustrates an embodiment of the present invention of a directional microphone 100 with sealed backside cavities 101A, 101B, each containing an electrode 102A, 102B, respectively. Backside cavities 101A-101B may collectively or individually be referred to as backside cavities 101 or backside cavity 101, respectively. Electrodes 102A-102B may collectively or individually be referred to as electrodes 102 or electrode 102, respectively. In one embodiment, a diaphragm 103A, 103B forms a portion of the topside of backside cavities 101A, 101B, respectively. Diaphragms 103A, 103B may collectively or individually be referred to as diaphragms 103 or diaphragm 103, respectively.

Microphone 100 may further include a rocking structure or beam 104 coupled to diaphragms 103. Rocking structure 104 is configured to "rock" or rotate on a pivot 105 as discussed further below. The structure of microphone 100 may reside on a substrate 106.

In one embodiment, backside cavities 101 are sealed with any gas, including air, and can be sealed under any pressure. In one embodiment, backside cavities 101 are sealed under vacuum so that no gas occupies the cavity.

In one embodiment, a plurality of capacitors are formed between diaphragms 103 and electrodes 102. In one embodiment, a portion of the capacitors are used for sensing and a portion of the capacitors are used for electrostatic actuation.

In one embodiment, rocking structure 104 provides resistance to deflection under external atmospheric pressure and will provide a directional response to small dynamic sound pressure as discussed below. When sound waves, which are small air pressure oscillations, arrive at microphone 100 in the y direction, as labeled in FIG. 1, the pressure oscillations impinge on both the right and left diaphragms 103 at the same time. Force is balanced on both sides of rocking structure 104 and there is no induced rocking motion. However, when sound waves arrive from the x direction, as labeled in FIG. 1, a pressure imbalance exists between the left and right diaphragms 103 due to the finite time it takes for sound to travel across microphone 100. This pressure imbalance applies a net moment to rocking structure 104 which in turn forces rocking structure 104 and diaphragms 103 into motion. As a result, rocking structure 104 has an inherently directional response to sound. Such a feature is useful as it can enable applications where one can point a microphone in a direction of interest to attain maximum sensitivity while simultaneously filtering out ambient sounds coming from the side that would otherwise affect speech intelligibility and signal-to-noise ratio (SNR).

Furthermore, diaphragms 103 are capable of resisting collapse under atmospheric pressure owing to the stiffness provided by rocking structure 104. In one embodiment, rocking structure 104 can be made completely insensitive to sound by including perforations into the structure of rocking structure 104 as shown in FIG. 2. Said perforations also aid in reducing damping of the structure as described below.

FIG. 2 illustrates the top view 200 of rocking structure 104 of directional microphone 100 in accordance with an embodiment of the present invention. Referring to FIG. 2, in conjunction with FIG. 1, since rocking structure 104 of directional microphone 100 is external to backside cavities 101, a small amount of air damping may occur underneath rocking structure 104. As a result, rocking structure 104 may include perforations 201 as shown in the top view 200 of rocking structure 104. As a result, air underneath rocking structure 104 can be displaced through these perforations 201 as rocking structure 104 rotates.

Additionally, rocking structure 104 may include a design that is triangular in shape, as shown in top view 200 of rocking structure 104, where rocking structure 104 is wider along pivot 105 and narrower along its edges in order to minimize the moment of inertia about its rotating axis.

Returning to FIG. 1, in one embodiment, microphone 100 may be designed to provide additional resistance to deflection under external atmospheric pressure by placing an electrostatic charge of one type (e.g., positive charge) on diaphragms 103 and placing an electrostatic charge of the same type on electrodes 102 thereby forming an electrostatic repulsion between diaphragms 103 and electrodes 102.

In another embodiment, microphone 100 may be designed to provide additional resistance to deflection under external atmospheric pressure by having diaphragms 103 be made out of a magnetic material (e.g., iron, nickel) which are then magnetized thereby generating a magnetic field. When current is run through diaphragms 103, the magnetic field exerts an additional upward force on diaphragm 103 to assist in preventing collapse under atmospheric pressure.

As discussed above, when sound waves arrive from the x direction, as labeled in FIG. 1, a pressure imbalance exists between the left and right diaphragms 103A and 103B due to the finite time it takes for sound to travel across microphone 100. This pressure imbalance applies a net moment to rocking structure 104 which in turn forces rocking structure 104 and diaphragms 103 into motion. The motion of rocking structure 104 and/or diaphragms 103 can be sensed using any number of transduction principles common to MEMS and acoustic sensors, such as piezoelectric, optical, piezoresistive and capacitive. For example, diaphragms 103 may be made electrically conductive so that parallel plate capacitors are formed by the diaphragms 103 and electrodes 102.

An alternative directional microphone where the rocking structure is sealed along with the electrodes in a backside cavity is discussed below in connection with FIG. 3.

FIG. 3 illustrates an alternative embodiment of the present invention of a directional microphone 300 with a sealed backside cavity 301 containing electrodes 302A, 302B and a rocking structure 303 configured to "rock" or rotate on a pivot 304. Electrodes 302A-302B may collectively or individually be referred to as electrodes 302 or electrode 302, respectively. Rocking structure 303 is connected to diaphragms 305A, 305B as shown in FIG. 3. Diaphragms 305A, 305B may collectively or individually be referred to as diaphragms 305 or diaphragm 305, respectively. The structure of microphone 300 may reside on a substrate 306.

In one embodiment, backside cavity 301 is sealed with any gas, including air, and can be sealed under any pressure. In one embodiment, backside cavity 301 is sealed under vacuum so that no gas occupies the cavity.

In one embodiment, a plurality of capacitors are formed between rocking structure 303 and electrodes 302. In one embodiment, a portion of the capacitors are used for sensing and a portion of the capacitors are used for electrostatic actuation.

As with the case of directional microphone 100 of FIG. 1, rocking structure 303 of directional microphone 300 provides resistance to deflection under external atmospheric pressure and will provide a directional response to small dynamic sound pressure as discussed below. When sound waves arrive at microphone 300 in the y direction, as labeled in FIG. 3, the pressure oscillations impinge on both the right and left diaphragms 305 at the same time. Force is balanced on both sides of rocking structure 303 and there is no induced rocking motion. However, when sound waves arrive from the x direction, as labeled in FIG. 3, a pressure imbalance exists. This pressure imbalance applied to diaphragms 305 in turn applies a net moment to rocking structure 303 which in turn forces rocking structure 303 and diaphragms 305 into motion. As a result, rocking structure 303 and diaphragms 305 have an inherently directional response to sound.

As with the case with microphone 100, rocking structure 303 can be designed very stiff to resist deflection under atmospheric pressure acting on each diaphragm 305. Atmospheric pressure is omnidirectional and therefore the atmospheric pressure is balanced on both diaphragms 305.

Furthermore, by placing rocking structure 303 inside a cavity 301, which may be vacuum sealed, the effects of air damping on the motion of rocking structure 303 are eliminated.

In addition, in one embodiment, rocking structure 303 may include a design that is triangular in shape that is similar to the shape shown in the top view 200 of rocking structure 104 (FIG. 2) in order to minimize the moment of inertia about its rotating axis. Perforations 201 may also be advantageous to further reduce moment of inertia.

Returning to FIG. 3, the operation of microphone 300 is similar in operation to microphone 100 (FIG. 1). For example, the motion of rocking structure 303 and/or diaphragms 305 can be sensed using any number of transduction principles common to MEMS and acoustic sensors, such as piezoelectric, optical, piezoresistive and capacitive. For example, the motion of rocking structure 303 can change a capacitance which can be sensed with electronics. For instance, rocking structure 303 may be made electrically conductive so that parallel plate capacitors are formed by the rocking structure 303 and electrodes 302.

As discussed above, microphones 100 and 300 include two diaphragms 103, 305 with sealed backside cavities 101, 301. In each microphone 100, 300, diaphragms 103, 305 are coupled to a rocking structure 104, 303 which will provide resistance to deflection under external atmospheric pressure and will provide a directional response to small dynamic sound pressure. Additionally, each microphone 100, 300 can be manufactured using MEMS surface-micromachining processes without the use of the through-wafer deep reactive ion etch to create a backside cavity. In one embodiment, microphones 100, 300 can be fabricated using a standard process with alternating sacrificial oxide and polysilicon layers, such as Sandia's SUMMiT™ V 5-level surface micromachining processes or MEMSCAP's poly-MUMPs process, as discussed below in connection with FIGS. 4A-4B, 5A-5J, 6*a*-6B, 7A-7J, 8 and 9A-9B. While the following discusses using such a sequence to fabricate microphones 100, 300, the principles of the present invention are not limited to such processes but can include other processes to fabricate microphones 100, 300. Furthermore, the principles of the present invention are not limited to enacting all the steps of a 5-level surface micromachining process. For example, some of the steps described below may be combined or eliminated, such as by depositing a fewer number of polysilicon and/or sacrificial oxide layers to fabricate the microphones 100, 300.

Referring to FIGS. 4A-4B, FIGS. 4A-4B are a flowchart of a method 400 for fabricating directional microphone 100 of FIG. 1. FIGS. 4A-4B will be discussed in conjunction with FIGS. 5A-5J, which depict cross-sectional views of microphone 100 during the fabrication steps described in FIGS. 4A-4B in accordance with an embodiment of the present invention.

Figure 5A:
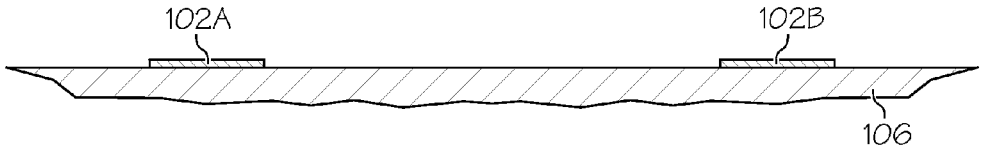
FIGS. 5A-5J depict cross-sectional views of the directional microphone of FIG. 1 during the fabrication steps described in FIGS. 4A-4B in accordance with an embodiment of the present invention.

Referring to FIG. 4A, in conjunction with FIGS. 1 and 5A-5J, in step 401, a first layer of polysilicon is deposited on substrate 106. Substrate 106 may be a blank silicon wafer or may be a silicon wafer with electrically insulating layers across its surface, such as silicon dioxide or silicon nitride. In one embodiment, a thickness of approximately 0.3 μm of polysilicon is deposited in step 401. In step 402, the first layer of polysilicon is patterned to form electrodes 102A, 102B as illustrated in FIG. 5A.

Figure 5B:
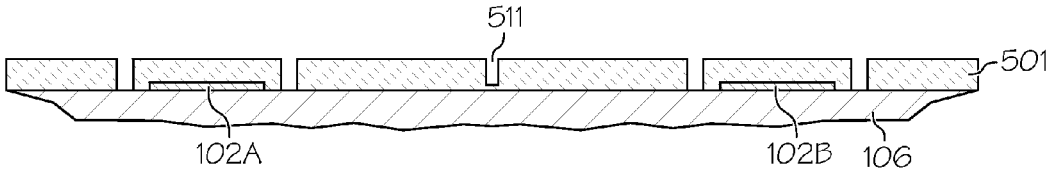
Figure 6A:
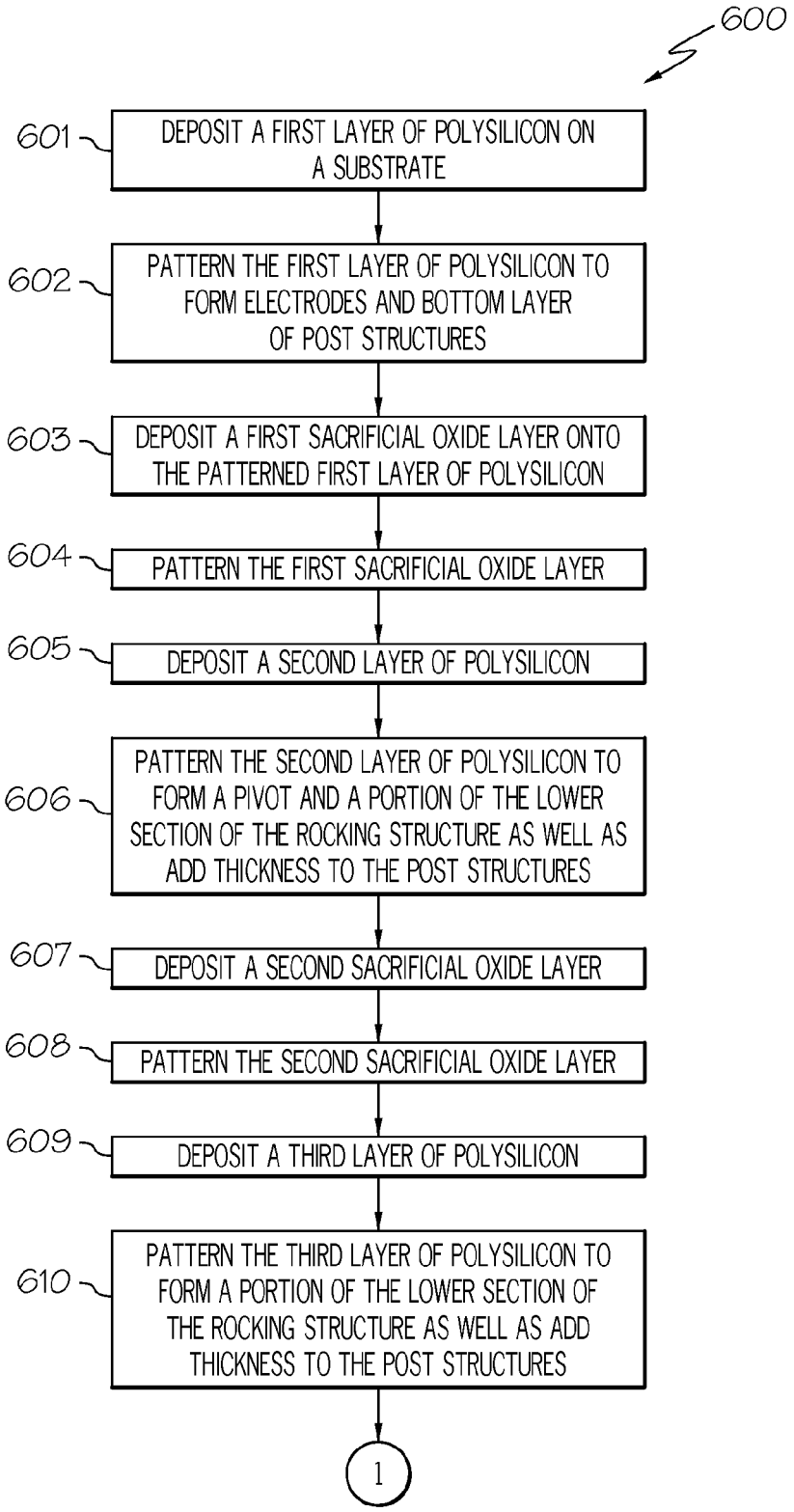
FIGS. 6A-6B are a flowchart of a method for fabricating the directional microphone of FIG. 3 in accordance with an embodiment of the present invention.
Figure 6B:
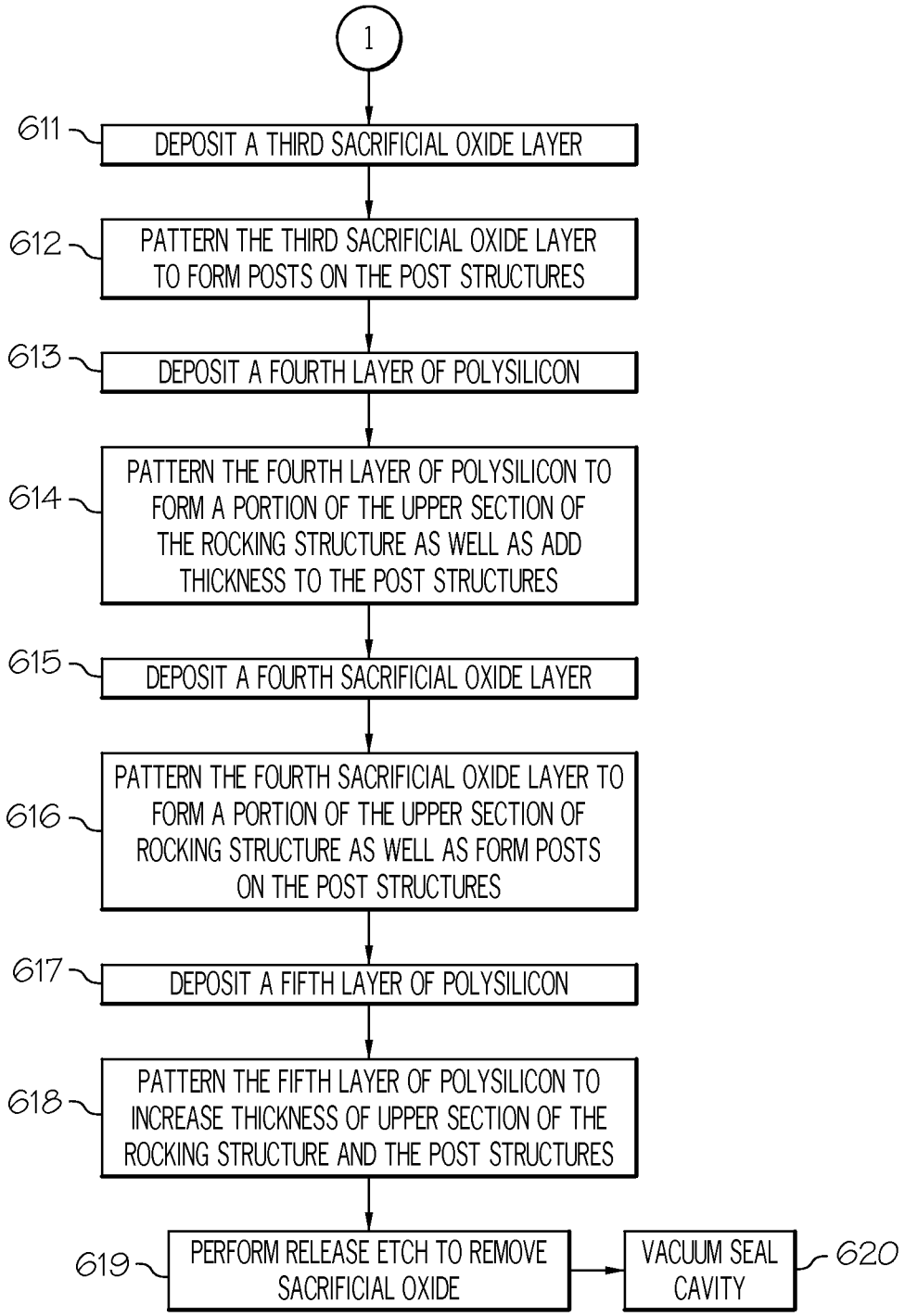

In step 403, a first sacrificial oxide layer is deposited onto the patterned first layer of polysilicon (structure of FIG. 5A). In one embodiment, a thickness of approximately 2 μm of sacrificial oxide is deposited in step 403. In step 404, the first sacrificial oxide layer 501 is patterned to define the height of the sealed cavities 101 as illustrated in FIG. 5B. In one embodiment, the patterning of first sacrificial oxide layer 501 may include making a dimpled cut 511 to create pivot 105 as shown in FIG. 5B. A "dimpled cut" 511, as used herein, refers to etching the sacrificial oxide layer 501 so that a portion of sacrificial oxide layer 501 remains above substrate 106.

In step 405, a second layer of polysilicon is deposited onto the structure of FIG. 5B. In one embodiment, a thickness of approximately 1 μm of polysilicon is deposited in step 405. In step 406, the second layer of polysilicon is patterned to form diaphragms 103, pivot 105 and a portion 502 of the lower section of rocking structure 104 as illustrated in FIG. 5C.

Figure 5C:
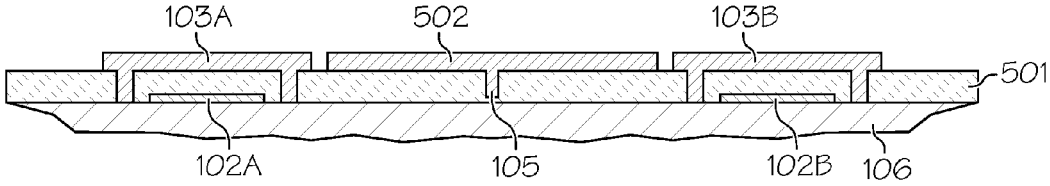

In step 407, a second sacrificial oxide layer is deposited onto the structure of FIG. 5C. In one embodiment, a thickness of approximately 0.3 μm of sacrificial oxide is deposited in step 407. In step 408, the second sacrificial oxide layer 503 is patterned as illustrated in FIG. 5D.

Figure 5D:
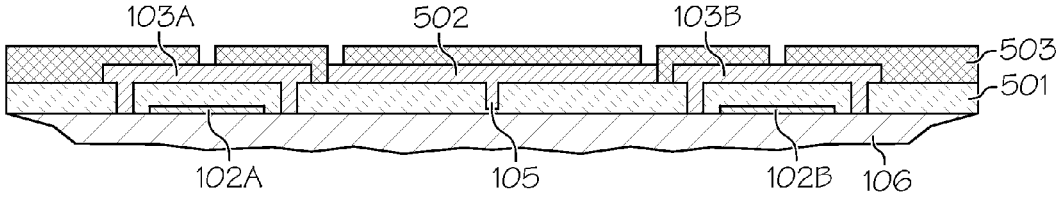
Figure 5E:
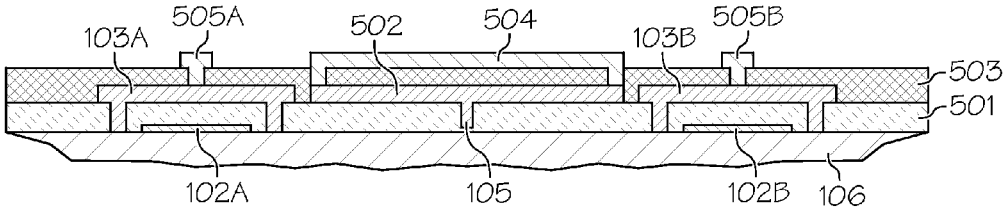

In step 409, a third layer of polysilicon is deposited onto the structure of FIG. 5D. In one embodiment, a thickness of approximately 1.5 μm of polysilicon is deposited in step 409. In step 410, the third layer of polysilicon is patterned to form a portion 504 of the lower section of rocking structure 104 as well as posts 505A, 505B on top of diaphragms 103A, 103B, respectively, as illustrated in FIG. 5E. Posts 505A, 505B are used to connect the diaphragms 103A, 103B to rocking structure 104 as shown further below.

Figure 5F:
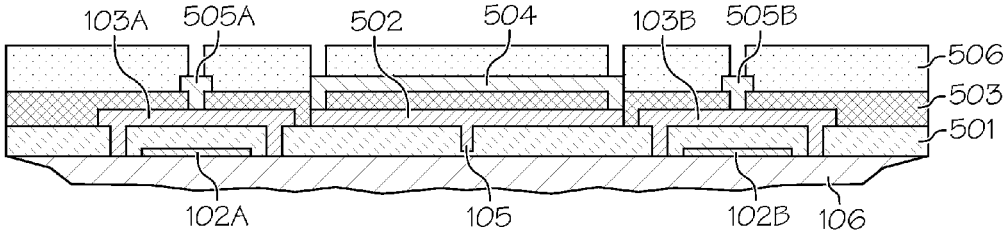

Referring to FIG. 4B, in conjunction with FIGS. 1 and 5A-5J, in step 411, a third sacrificial oxide layer is deposited onto the structure of FIG. 5E. In one embodiment, a thickness of approximately 2 μm of sacrificial oxide is deposited in step 411. In step 412, the third sacrificial oxide layer 506 is patterned as illustrated in FIG. 5F.

In step 413, a fourth layer of polysilicon is deposited onto the structure of FIG. 5F. In one embodiment, a thickness of approximately 2.25 μm of polysilicon is deposited in step 413. In step 414, the fourth layer of polysilicon is patterned to form a portion 507 of the upper section of rocking structure 104 as well as form touchdowns 508A, 508B to diaphragms 103A, 103B as illustrated in FIG. 5G.

Figure 5G:
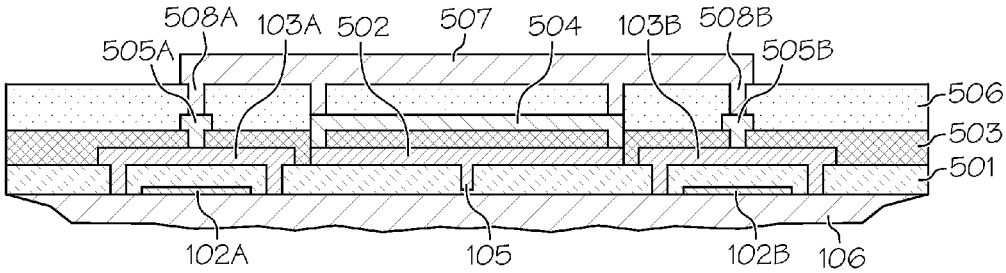

In step 415, a fourth sacrificial oxide layer is deposited onto the structure of FIG. 5G. In one embodiment, a thickness of approximately 2.0 μm of sacrificial oxide is deposited in step 415. In step 416, the fourth sacrificial oxide layer 509 is patterned as illustrated in FIG. 5H.

Figure 5H:
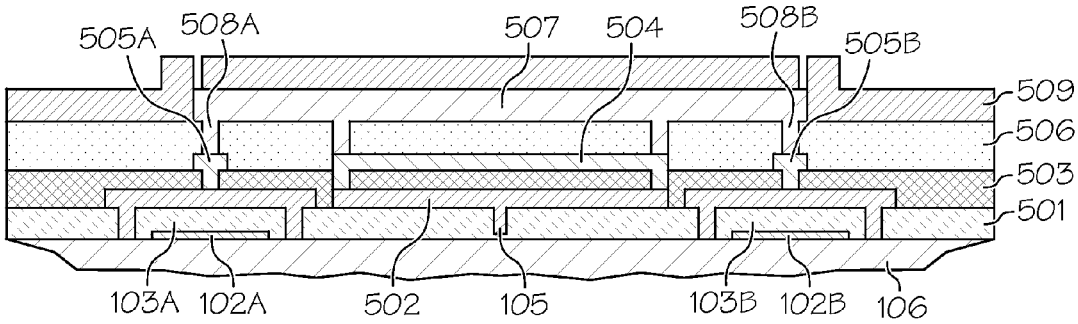
Figure 5I:
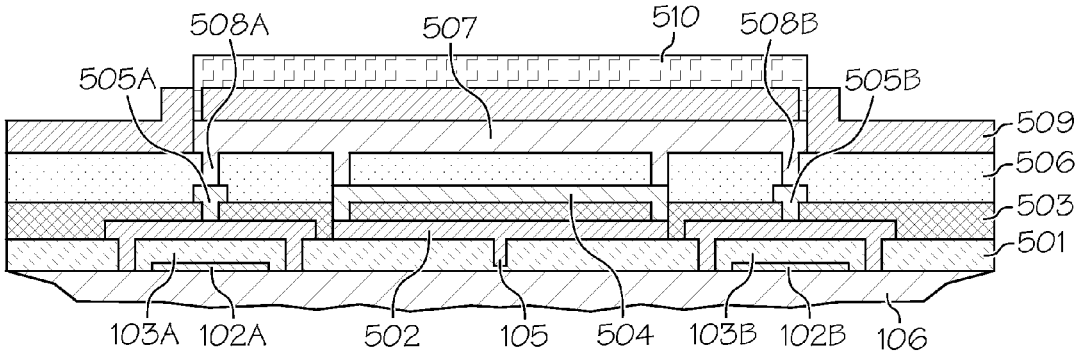

In step 417, a fifth layer of polysilicon is deposited onto the structure of FIG. 5H. In one embodiment, a thickness of approximately 2.25 μm of polysilicon is deposited in step 417. In step 418, the fourth layer of polysilicon is patterned to increase the thickness 510 of the upper section of rocking structure 104 as illustrated in FIG. 5I.

Figure 5J:
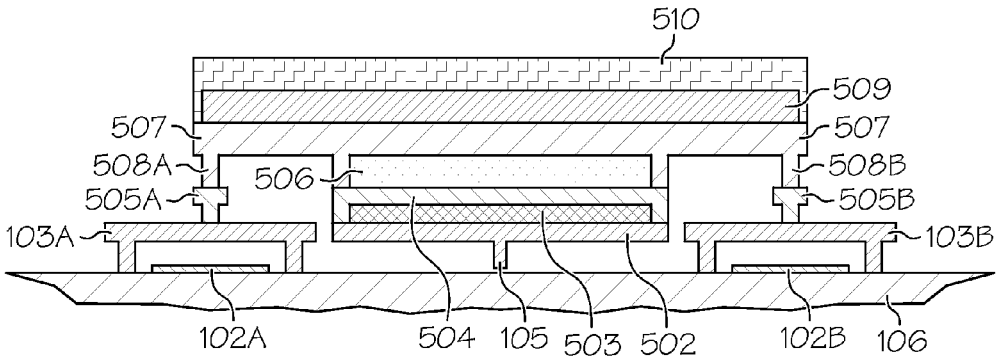

In step 419, a release etch is performed to remove the sacrificial oxide as illustrated in FIG. 5J. In step 420, cavities 101 may be vacuum sealed via deposition of a thin material layer (e.g., a metal) which fills small etch holes in diaphragms 103. This sealing step will be described in greater detail below. Pivot 105 will touch down when microphone 100 deflects under atmospheric pressure when sealed.

In some implementations, method 400 may include other and/or additional steps that, for clarity, are not depicted. Further, in some implementations, method 400 may be executed in a different order presented and that the order presented in the discussion of FIGS. 4A-4B is illustrative. Additionally, in some implementations, certain steps in method 400 may be executed in a substantially simultaneous manner or may be omitted.

An embodiment of a method for fabricating directional microphone 300 of FIG. 3 will now be discussed below in connection with FIGS. 6A-6B, 7A-7J, 8 and 9A-9B.

FIGS. 6A-6B are a flowchart of a method 600 for fabricating directional microphone 300 of FIG. 3. FIGS. 6A-6B will be discussed in conjunction with FIGS. 7A-7J, which depict cross-sectional views of microphone 300 during the fabrication steps described in FIGS. 6A-6B in accordance with an embodiment of the present invention.

Figure 7A:
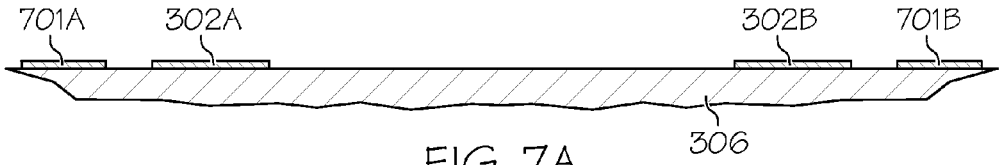
FIGS. 7A-7J depict cross-sectional views of the directional microphone of FIG. 3 during the fabrication steps described in FIGS. 6A-6B in accordance with an embodiment of the present invention.

Referring to FIG. 6A, in conjunction with FIGS. 3 and 7A-7J, in step 601, a first layer of polysilicon is deposited on substrate 306. In one embodiment, a thickness of approximately 0.3 μm of polysilicon is deposited in step 601. In step 602, the first layer of polysilicon is patterned to form electrodes 302A, 302B and the bottom layer 701A, 701B of the post structures as illustrated in FIG. 7A.

Figure 7B:
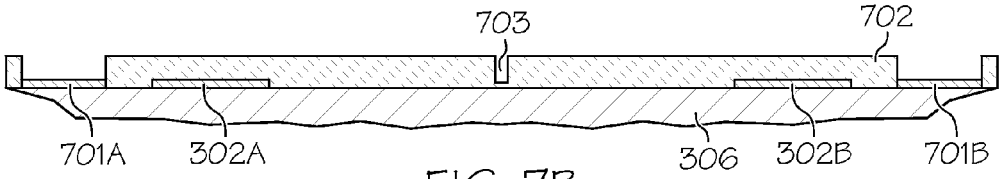

In step 603, a first sacrificial oxide layer is deposited onto the patterned first layer of polysilicon (structure of FIG. 7A). In one embodiment, a thickness of approximately 2 μm of sacrificial oxide is deposited in step 603. In step 604, the first sacrificial oxide layer 702 is patterned as illustrated in FIG. 7B. In one embodiment, the patterning of first sacrificial oxide layer 702 may include making a dimpled cut 703 to create pivot 304 as shown in FIG. 7B. A "dimpled cut" 703, as used herein, refers to etching the sacrificial oxide layer 702 so that a portion of sacrificial oxide layer 702 remains above substrate 306.

In step 605, a second layer of polysilicon is deposited onto the structure of FIG. 7B. In one embodiment, a thickness of approximately 1 μm of polysilicon is deposited in step 605. In step 606, the second layer of polysilicon is patterned to form pivot 304, a portion 704 of the lower section of rocking structure 303 as well as to add thickness 705A, 705B to the post structures as illustrated in FIG. 7C.

Figure 7C:
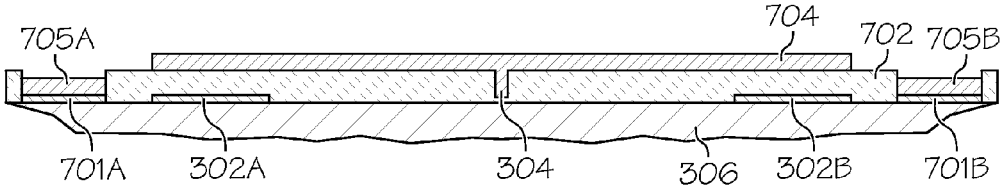

In step 607, a second sacrificial oxide layer is deposited onto the structure of FIG. 7C. In one embodiment, a thickness of approximately 0.3 μm of sacrificial oxide is deposited in step 607. In step 608, the second sacrificial oxide layer 706 is patterned as illustrated in FIG. 7D.

Figure 7D:
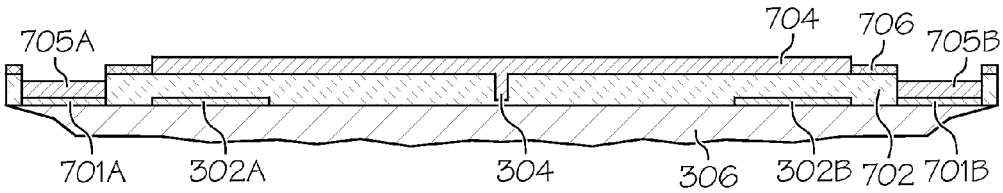

In step 609, a third layer of polysilicon is deposited onto the structure of FIG. 7D. In one embodiment, a thickness of approximately 1.5 μm of polysilicon is deposited in step 609. In step 610, the third layer of polysilicon is patterned to form a portion 707 of the lower section of rocking structure 303 as well as to add thickness 708A, 708B to the post structures as illustrated in FIG. 7E.

Figure 7E:
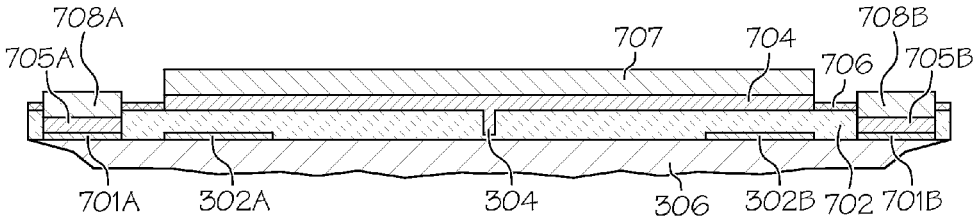
Figure 7F:
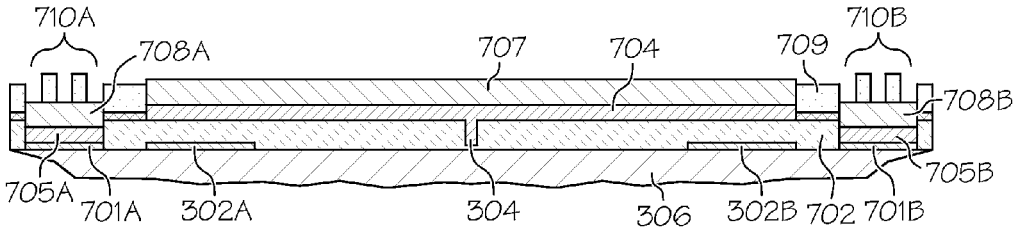

Referring to FIG. 6B, in conjunction with FIGS. 3 and 7A-7J, in step 611, a third sacrificial oxide layer is deposited onto the structure of FIG. 7E. In one embodiment, a thickness of approximately 2 μm of sacrificial oxide is deposited in step 611. In step 612, the third sacrificial oxide layer 709 is patterned to form posts 710A, 710B on post structures 701, 705, 708 as illustrated in FIG. 7F.

In step 613, a fourth layer of polysilicon is deposited onto the structure of FIG. 7F. In one embodiment, a thickness of approximately 2.25 μm of polysilicon is deposited in step 613. In step 614, the fourth layer of polysilicon is patterned to form a portion 711 of the upper section of rocking structure 303 as well as to add thickness 712A, 712B to the post structures as illustrated in FIG. 7G.

Figure 7G:
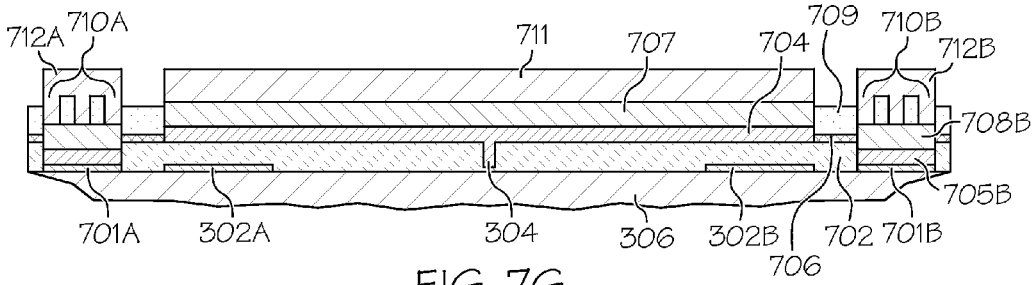

In step 615, a fourth sacrificial oxide layer is deposited onto the structure of FIG. 7G. In one embodiment, a thickness of approximately 2.0 μm of sacrificial oxide is deposited in step 615. In step 616, the fourth sacrificial oxide layer 713 is patterned to form a portion 714 of the upper section of rocking structure 303 as well as form to posts 715A, 715B on post structures 701, 705, 708, 710, 712 as illustrated in FIG. 7H.

Figure 7H:
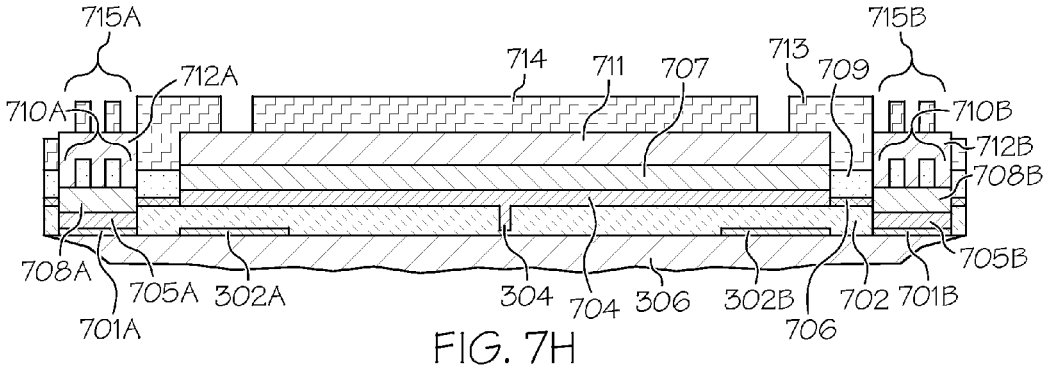
Figure 7I:
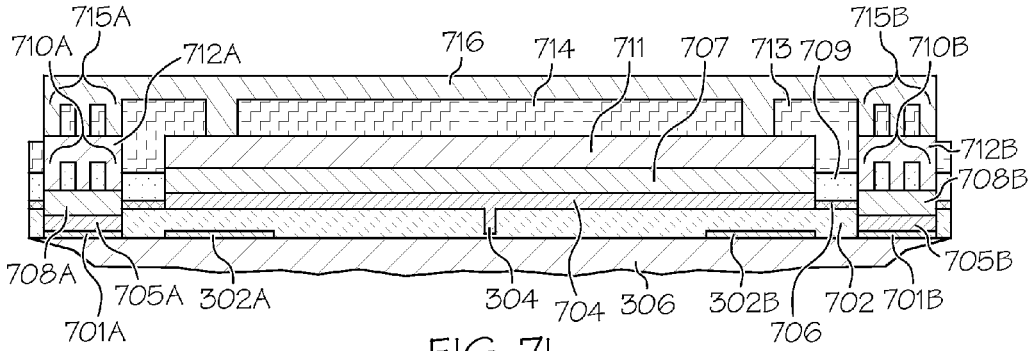

In step 617, a fifth layer of polysilicon is deposited onto the structure of FIG. 7H. In one embodiment, a thickness of approximately 2.25 μm of polysilicon is deposited in step 617. In step 618, the fifth layer of polysilicon 716 is patterned to increase the thickness of the upper section of rocking structure 303 and the post structures as illustrated in FIG. 7I.

Figure 7J:
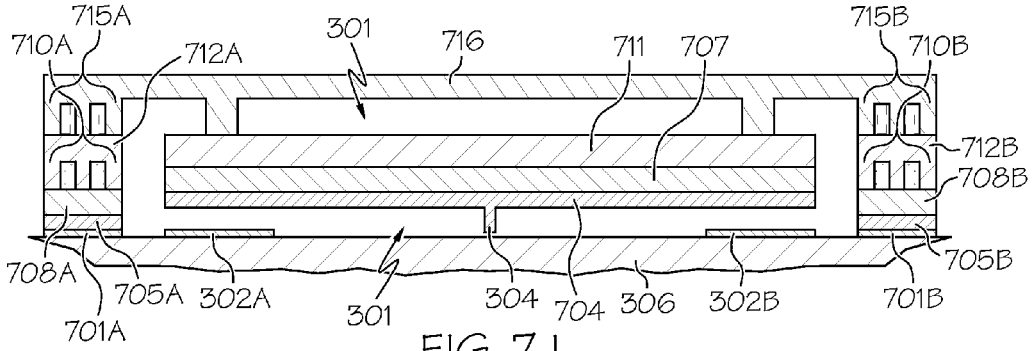

In step 619, a release etch is performed to remove the sacrificial oxide as illustrated in FIG. 7J. In step 620, cavity 301 is vacuum sealed as discussed further below.

In some implementations, method 600 may include other and/or additional steps that, for clarity, are not depicted. Further, in some implementations, method 600 may be executed in a different order presented and that the order presented in the discussion of FIGS. 6A-6B is illustrative. Additionally, in some implementations, certain steps in method 600 may be executed in a substantially simultaneous manner or may be omitted.

An additional view of the top surface of microphone 300 is provided below in connection with FIG. 8. FIG. 8 illustrates a portion of the top surface of microphone 300 that includes a circular pattern of posts that extends from the top surface of microphone 300 to the substrate in accordance with an embodiment of the present invention.

Referring to FIG. 8, in conjunction with FIGS. 3, 6A-6B and 7A-7J, a diaphragm region 801 is formed by the free membrane between various posts 802A-D arranged in a circular or any other manner. Posts 802A-D may collectively or individually be referred to as posts 802 or post 802, respectively. While FIG. 8 illustrates four posts 802 arranged in a circular manner, any number of posts 802 may be arranged in a circular manner. In one embodiment, posts 802 extend from the top surface of microphone 300 to the substrate level 306. Additionally, a post 803 connects the center of diaphragm 305 to rocking structure 303. Furthermore, a rigid side-wall 804 may surround microphone 300 as illustrated in FIG. 8.

FIGS. 9A and 9B illustrate the process of vacuum sealing microphone 300 in accordance with an embodiment of the present invention. Referring to FIG. 9A, in conjunction with FIGS. 3, 6A-6B and 7A-7J, an etch release hole 901 exists at a portion of the top surface layer 716 of microphone 300. Etch release hole 901 is used so that the sacrificial oxide can be removed in step 619. A portion of an underlying polysilicon layer (e.g., polysilicon layer 711) is structured as a lip 902 that is used to collect a sealant (e.g., a metal applied during a sputtering or evaporation process step) when it is applied to the top surface layer 716 of microphone 300, thereby forming a sealing layer 903 as illustrated in FIG. 9B. This same technique is applicable to microphone 100 (FIG. 1), in which case the etch hole should reside on diaphragm 103 (FIG. 1).

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A microphone comprising:

a first diaphragm and a second diaphragm, wherein said first and second diaphragms form a top layer of a first backside sealed cavity and a second backside sealed cavity, wherein said first and second backside sealed cavities are sealed under a reduced pressure less than that of an ambient pressure that exists outside of said first and second backside sealed cavities; and a rocking structure coupled to said first and second diaphragms, wherein said rocking structure rotates on a pivot, wherein said rocking structure is placed external to said first and second backside sealed cavities.

2. The microphone as recited in claim 1, wherein said first and second backside sealed cavities comprise a first electrode and a second electrode, respectively.

3. The microphone as recited in claim 2, wherein said first and second diaphragms are electrically conductive, wherein parallel plate capacitors are formed between said first and second diaphragms and said first and second electrodes, respectively.

4. The microphone as recited in claim 2, wherein an electrostatic charge is placed on said first and second diaphragms and an electrostatic charge of a same type is placed on said first and second electrodes.

5. The microphone as recited in claim 1, wherein said first and second backside sealed cavities comprise a plurality of electrodes thereby forming a plurality of capacitors between said first and second diaphragms and said plurality of electrodes.

6. The microphone as recited in claim 5, wherein a portion of said plurality of capacitors are used for sensing, wherein a portion of said plurality of capacitors are used for electrostatic actuation.

7. The microphone as recited in claim 1, wherein said first and second backside sealed cavities are vacuum sealed.

8. The microphone as recited in claim 1, wherein said rocking structure turns into motion when pressure arrives from a horizontal direction.

9. The microphone as recited in claim 1, wherein said first and second diaphragms are repulsed upwards by use of magnetic forces.

10. The microphone as recited in claim 9, wherein current is run through said first and second diaphragms thereby creating a magnetic field.

11. A microphone comprising:

a diaphragm, wherein said diaphragm forms a top layer of a backside sealed cavity wherein said backside sealed cavity; comprises a first electrode and a second electrode;

a rocking structure coupled to said diaphragm, wherein said rocking structure rotates on a pivot, wherein said rocking structure is placed internal in said backside sealed cavity, and wherein said rocking structure is electrically conductive, wherein parallel plate capacitors are formed between said rocking structure and said first and second electrodes.

12. The microphone as recited in claim 11, wherein said first and second electrodes are positioned beneath said rocking structure.

13. The microphone as recited in claim 11, wherein an electrostatic charge is placed on said diaphragm and an electrostatic charge of a same type is placed on said first and second electrodes.

14. The microphone as recited in claim 11, wherein said backside sealed cavity comprises a plurality of electrodes thereby forming a plurality of capacitors between said rocking structure and said plurality of electrodes.

15. The microphone as recited in claim 14, wherein a portion of said plurality of capacitors are used for sensing, wherein a portion of said plurality of capacitors are used for electrostatic actuation.

16. The microphone as recited in claim 11, wherein said backside sealed cavity is vacuum sealed.

17. The microphone as recited in claim 11, wherein said rocking structure turns into motion when pressure arrives from a horizontal direction.

18. The microphone as recited in claim 11, wherein said diaphragm is repulsed upwards by use of magnetic forces.

19. The microphone as recited in claim 18, wherein current is run through said diaphragm thereby creating a magnetic field.

20. The microphone as recited in claim 11, wherein a plurality of posts extend from a top surface of said microphone to a substrate of said microphone.

21. The microphone as recited in claim 20, wherein said posts protrude through holes in said rocking structure.

* * * * *